United States Patent [19]

Turner

[11] Patent Number: 4,548,443

[45] Date of Patent: Oct. 22, 1985

[54] TUNNEL BORING MACHINE

[75] Inventor: John Turner, Renton, Wash.

[73] Assignee: The Robbins Company, Kent, Wash.

[21] Appl. No.: 627,354

[22] Filed: Jul. 3, 1984

[51] Int. Cl.[4] ..... E21C 29/02

[52] U.S. Cl. ..... 299/31; 299/55

[58] Field of Search ..... 299/31, 55, 58

[56] References Cited

U.S. PATENT DOCUMENTS

| | | | |
|---|---|---|---|
| 3,598,445 | 8/1971 | Winberg | 299/31 |
| 3,861,748 | 1/1975 | Cass | 299/31 |
| 3,920,277 | 11/1975 | Winberg et al. | 299/31 |
| 4,420,188 | 12/1983 | Robbins et al. | 299/31 |
| 4,432,665 | 2/1984 | Stuckmann et al. | 299/31 |

*Primary Examiner*—Stephen J. Novosad
*Assistant Examiner*—Michael Goodwin
*Attorney, Agent, or Firm*—Graybeal & Cullom

[57] ABSTRACT

A tunnel boring machine including the following elements: (a) a full face rotary cutterhead; (b) a cutterhead support on which the cutterhead is mounted; (c) a gripper system carried by a gripper support frame for reacting thrust, steering, roll correction, and torque forces; (d) a conveyor system for transporting muck from behind the rotary cutterhead to a dump point rearwardly of the machine; (e) primary propel cylinders for advancing the cutterhead which are mounted between the gripper support frame and the cutterhead support, the primary propel cylinders consisting of a series of at least three pairs of double acting hydraulic cylinders arranged annularly in equally spaced apart locations and in a series of V-shaped configurations between the gripper support frame and the cutterhead support, each such pair of primary propel cylinders having an included angle between the cylinders of about 15° and 60° and with a line bisecting the included angle between the cylinders extending generally parallel to the longitudinal centerline of the machine; and (f) a hydraulic control system for controlling the pairs of primary propel cylinders to effect (1) axial forward thrust on the cutterhead by simultaneous actuation of all the primary propel cylinders while transmitting the reaction torque exerted on the cutterhead support by rotation of the cutterhead, (2) steering of the cutterhead support and the cutterhead by selective actuation of only a portion of the primary propel cylinders, and (3) roll corrections of the cutterhead support and the cutterhead by selective actuation of alternate members of the primary propel cylinders.

6 Claims, 8 Drawing Figures

TUNNEL BORING MACHINE

BACKGROUND OF THE INVENTION

1. Field of the Invention

This invention relates to tunnel boring machines. In one embodiment, the invention relates to a full-face rotary cutterhead, double shield tunnel boring machine that is adapted to bore through a variety of geological structures, ranging from self-supporting rock to that requiring continuous lining support. The disclosed machine has high thrust capability for hard rock applications and a double shield to support poor ground until tunnel supports can be installed. A novel feature of the present invention, which is not limited to double shield machines, is that the primary propel cylinders are arranged in a series of at least three pairs in staggered pattern to perform the multiple functions of providing forward thrust, transmission of reaction torque, steering control, and roll corrections. Each propel cylinder is individually controllable and the propel cylinder pairs can be operated in either the forward thrust mode or in a hold-back mode for steering and roll corrections. This hold-back feature provides positive steering for the front portion of the machine.

2. Description of the Prior Art

The prior art includes the double shield tunnel boring machine disclosed in Robbins et al U.S. Pat. No. 4,420,188. The novel improvement in the present invention over that shown in the Robbins et al patent involves the use of a series of at least three pairs of hydraulic primary propel cylinders between the first and second shields, with each pair of primary propel cylinders being arranged in a V-shaped configuration having an included angle of about 15° to 60° in a plane generally parallel to the adjacent portions of the shields and with the line bisecting the included angle being substantially parallel to the longitudinal centerline of the machine. The pairs of primary propel cylinders rigidly tie the first and second shields together and perform the multiple functions of axial thrust (by simultaneous actuation), of transmitting reaction torque from the cutterhead support to the gripper system thereby countering the reverse rotary displacement of the cutterrhead support caused by the rotary torque applied to the cutterhead, of steering (by selective actuation causing angular displacement of the first shield, the cutterhead support, and the cutterhead relative to the second shield which is held stationary by the gripper system), and of roll correction (by selective actuation causing clockwise or counterclockwise rotation of the first shield, the cutterhead support, and the cutterhead relative to the second shield which is held stationary by the gripper system). Thus, the novel primary propel cylinder pairs have a forward thrust function, a reaction torque function, a steering function, and a roll correction function. They provide at all times a rigid structure between the first and second shields, replacing the conventional axially disposed rearwardly extendable thrust cylinders (such as the thrust rams 52 in Robbins et al U.S. Pat. No. 4,420,188), eliminating the need for separate reaction torque cylinders (such as the reaction torque cylinders 152 and 154 in the Robbins et al. patent), and also eliminating the need for precise control of the length of the reaction torque cylinders during the axial thrust stroke (such as in the Robbins et al patent where, in order to maintain the first shield nonrotative with respect to the second shield, the extension of the torque cylinders 152 and 154 had to progressively change during the pivotal movement thereof caused by the forward axial movement of the first shield).

SUMMARY OF THE INVENTION

One aspect of the invention is a tunnel boring machine including the following elements: (a) a full face rotary cutterhead; (b) a cutterhead support on which the cutterhead is mounted; (c) a gripper system carried by a gripper support frame for reacting machine thrust, steering, roll correction, and torque forces; (d) a conveyor system for transporting muck from behind the rotary cutterhead to a dump point rearwardly of the machine; (e) primary propel cylinders for advancing the cutterhead that are mounted between the gripper support frame and the cutterhead support, wherein the primary propel cylinders consist of a series of at least three pairs of double acting hydraulic cylinders arranged annularly in equally spaced apart locations and in a series of V-shaped configurations between the gripper support frame and the cutterhead support, each such pair of primary propel cylinders having an included angle between the cylinders of about 15° to 60° and with a line bisecting the included angle between the cylinders extending generally parallel to the longitudinal centerline of the machine; and (f) a hydraulic control system for controlling the pairs of primary propel cylinders to effect (1) axial forward thrust on the cutterhead by simultaneous actuation of all the primary propel cylinders while transmitting to the gripper system the reaction torque exerted on the cutterhead support by rotation of the cutterhead, (2) steering of the cutterhead support and the cutterhead by selective actuation of only a portion of the primary propel cylinders, and (3) roll corrections of the cutterhead support and the cutterhead by selective actuation of alternate members of the primary propel cylinders.

Another aspect of the invention is a method of boring a tunnel in rock including the following steps. As a first step, providing a full-face rotary cutterhead for cutting the rock, the cutterhead having a substantially horizontal axis of rotation and having multiple rolling cutter units each rotatable about its own axis. As a second step, while rotating the cutterhead about its substantially horizontal axis, axially thrusting the cutterhead forward into the rock work face by simultaneously actuating all of the primary propel cylinders located rearwardly from the cutterhead, the primary propel cylinders consisting of a series of at least three pairs of double-acting hydraulic cylinders arranged annularly in equally spaced apart locations, each such pair of primary propel cylinders having a V-shaped configuration with an included angle between the cylinders of about 15° to 60° and with a line bisecting the included angle between the cylinders extending generally parallel to the axis of rotation of the cutterhead, and while axially thrusting the cutterhead forward, transmitting the reaction torque created by rotation of the cutterhead through alternate members of the primary propel cylinders to a gripper system pressing against the tunnel wall at a location rearward from the primary propel cylinders. As a third step, making steering and roll adjustments to the cutterhead by selectively actuating only a portion of the primary propel cylinders. And, as a fourth step, while rotating the cutterhead, removing the rock cuttings from the work face.

BRIEF DESCRIPTION OF THE DRAWINGS

FIG. 1 shows in side elevation two of the four pairs of propel cylinders employed in the first embodiment.

FIG. 5 shows in side elevation three of the six pairs of propel cylinders in the staggered or lattice arrangement employed in the second embodiment.

DESCRIPTION OF THE PREFERRED EMBODIMENTS

Figure 1:
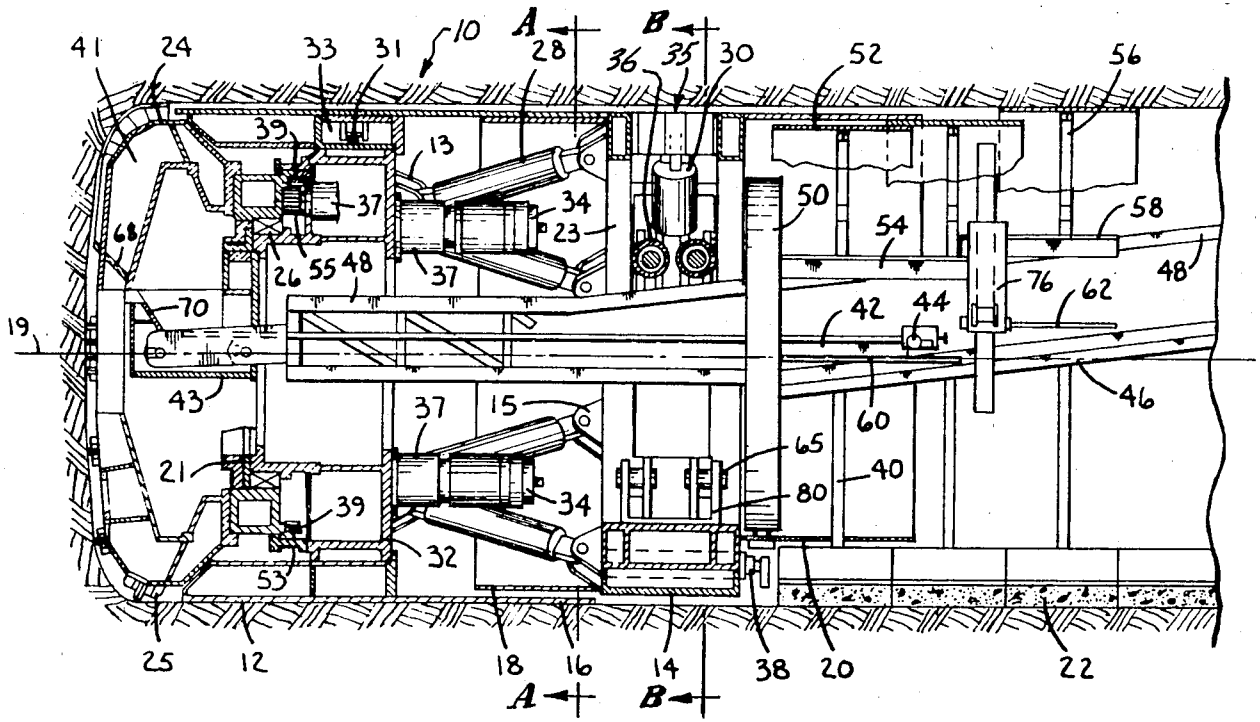
FIG. 1 is a partial longitudinal cross-sectional view of a first embodiment of a tunnel boring machine constructed according to the principles of the present invention, with some of the machine parts shown in side elevation.

Referring to FIG. 1, the first embodiment of the invention shown in this drawing is the tunnel boring machine 10 which has a diameter of about 5.6 meters and which comprises a pair of telescopically joined tubular front and rear shields 12 and 14. The rear shield assembly 14 telescopes into the front shield 12. In this respect, the present invention is similar to the machine disclosed in Robbins et al U.S. Pat. No. 4,420,188, the disclosure of which is incorporated herein by reference. The front shield 12 comprises a rear section 16 which overlaps the forward portion 18 of rear shield 14. Rear shield 14 includes an elongated rearwardly extending tail section 20 within which a sectional tunnel lining 22 is constructed.

The full face rotary cutterhead 24 provides basic radial stability while exposing a minimum of unsupported ground. The front and rear shields 12 and 14 provide full ground support back to the rear of the lining installation area. The forward shield 12 surrounds the cutterhead support structure 32 and provides ground support immediately behind the gauge cutters 25. The large area crab leg, window type gripper system 35 mounted on the circular rear shield/gripper support frame 23 provides low unit ground loading for reacting machine thrust, torque, and steering forces.

Figure 3:
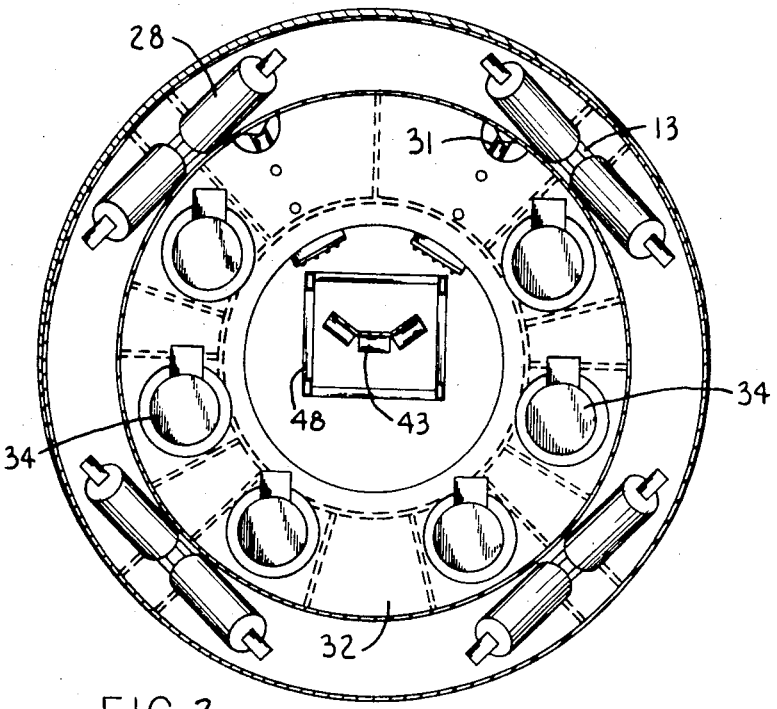
FIG. 3 is a radial cross-sectional view looking forward taken along line A—A of FIG. 1.

The cutterhead 24 is a heavy dome-shaped steel frame assembly. It is supported on the large diameter tapered roller main bearing 26. The cutterhead 24 is rotated by six electric motors 34 (FIG. 3). The power from motors 34 is transmitted through the gearbox assemblies 37 to pinion gears 55 which engage a large ring gear 39 mounted on the rear portion of the cutterhead assembly 24. Buckets 41 on the cutterhead pick up the muck and deposit it on the conveyor 43 located inside the cutterhead 24.

Figure 2:
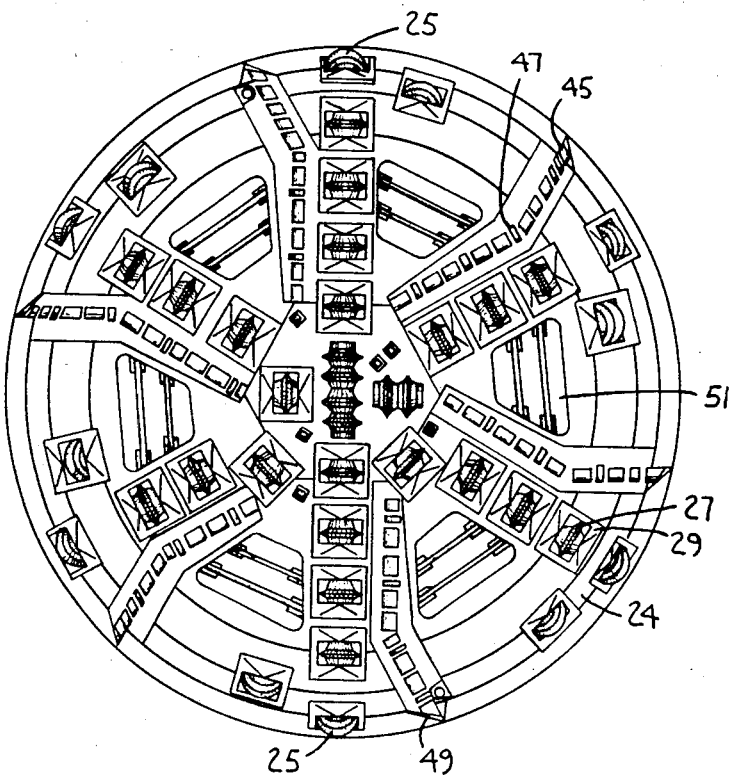
FIG. 2 is a front elevational view of the full-face rotary cutterhead assembly illustrated in FIG. 1.

Rolling disc cutter assemblies 27 (FIG. 2) are mounted in individual housings 29 welded to the cutterhead 24. The cutter housings 29 accept the cutter assemblies 27 from the rear. Removable bucket lips 45 and drag bits 47 are included in the cutterhead design. Two sets of gravity type invert scrapers 49 are provided to maintain a clean invert. The cutterhead 24 includes six access openings 51.

The cutterhead support 32 (FIG. 3) and the front shield 12 support the cutterhead 25. The cutterhead support 32 is a heavy frame structure which mounts the main bearing 26, the motors 34, the gearbox assemblies 37, and the front stabilizer cylinders 31. The front shield 12 forms the outer structure of the cutterhead support 32. The front shield 12 also houses the front stabilizer shoes 33 which extend during the boring operation to stabilize the cutterhead 24 and to lock the front shield 12 in the tunnel so that the rear shield 14 can be pulled forward during the recycle. The angled primary propel cylinders 28 are double acting hydraulic cylinders and are mounted in pairs between the front shield 12 and the rear shield 14. The propel cylinders 28 are mounted on the trunnion-type front mounting brackets 13 secured to the cutterhead support 32 and on the trunnion-type rear mounting brackets 15 secured to the rear shield/gripper support frame 23.

As shown in FIGS. 1 and 3, the primary propel cylinders 28 are arranged annularly in four equally spaced pairs located between the front shield 12 and the rear shield 14. At least three pairs of propel cylinders 28 are required. Each pair of propel cylinders 28 is mounted in a V-shaped configuration having an included angle of about 15° to 60° in a plane which is generally parallel to the adjacent portions of the shields and with the line bisecting the included angle between the propel cylinders 28 being substantially parallel to the longitudinal centerline 19 of the machine 10. The pairs of propel cylinders 28 rigidly tie the first and second shields 12 and 14 together. Furthermore, the propel cylinders 28 perform the multiple functions of axial forward thrust when the propel cylinders 28 are all simultaneously actuated, of transmitting reaction torque from the cutterhead support 32 to the gripper system 35 thereby countering the reverse rotary displacement of the cutterhead support 32 caused by the rotary torque applied to the cutterhead 24 by the motors 34, of steering by selectively actuating specific propel cylinders 28 causing angular displacement of the front shield 12, the cutterhead support 32, and the cutterhead 24 relative to the rear shield 14 which is held stationary in the tunnel by the gripper system 35, and of roll corrections by selectively actuating specific propel cylinders 28 causing clockwise or counterclockwise rotation of the front shield 12, the cutterhead support 32, and the cutterhead 24 relative to the rear shield 14 which is held stationary in the tunnel by the gripper system 35. Each primary propel cylinder 28 is individually controlled and can be operated in either the forward thrust mode or in a hold-back mode for steering corrections. This hold-back mode provides positive steering for the front shield 12. Thus, the pairs of primary propel cylinders 28 have a thrust function, a reaction torque function, a steering function, and a roll correction function.

The main bearing 26 is mounted on the forward portion of the cutterhead support 32. The large ring gear 39 is mounted on the rear portion of the cutterhead assembly 24 and rearward from the bearing 26. The bearing 26 and ring gear 39 are in a chamber which is completely sealed and lubricated. Two large diameter seals 21 and 53 protect the main bearing 26 and the ring gear 39 from contamination.

The cutterhead 24 is driven through the gearbox assemblies 37 which contain multiple planetary gear reducers with air operated clutches. Each gearbox assembly 37 has a drive pinion 55 on the output shaft. The gearbox assemblies 37 are mounted in openings in the cutterhead support 32. The ring gear 39 and the pinions 55 have a reversible design thereby doubling their useful life.

Figure 4:
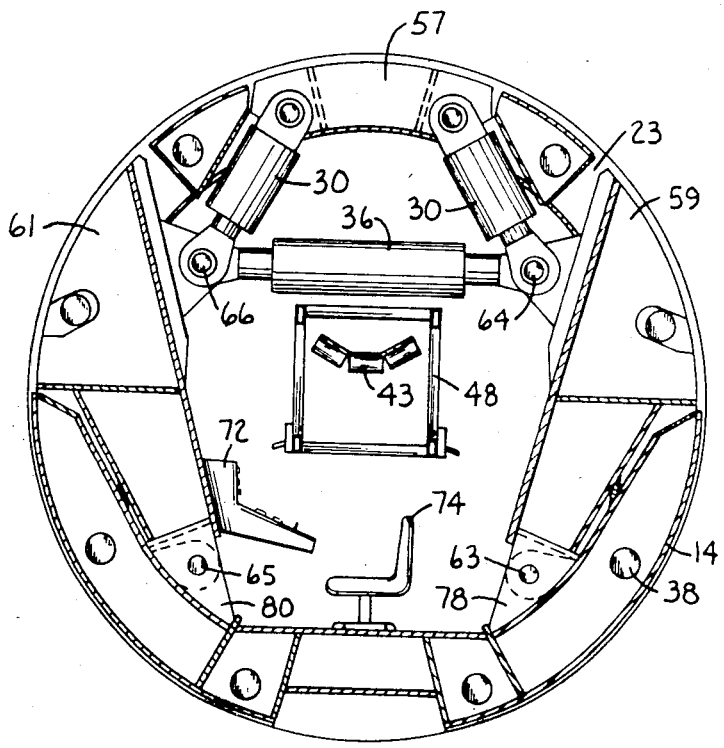
FIG. 4 is a radial cross-sectional view looking forward taken along line B—B of FIG. 1.

The telescoping rear shield 14 consists of the shield structure, the crab leg window-type gripper system 35, a forward shield section 18 which telescopes into the front shield 12, a tail section 20, and eight auxiliary thrust cylinders 38 (FIG. 4).

The three gripper shoes 57, 59, and 61 (FIG. 4) operate through windows in the rear shield 14. The right and left gripper shoes 59 and 61 are hinged on pins 63 and 65 in mounting brackets 78 and 80 which are secured to the lower portion of the rear shield/gripper support frame 23. Gripper shoes 59 and 61 are connected through the two transverse expansion hydraulic cylinders 36 to the upper shoe connection pins 64 and 66. The primary propel cylinders 28 (FIG. 3) are anchored to the front shield 12 and thrust against the rear shield/gripper support frame 23 into the gripper shoes 57, 59, and 61 into the tunnel wall. In poor ground conditions, the auxiliary thrust cylinders 38 can provide forward thrust against the tunnel lining 22.

The operating cycle of the tunnel boring machine 10 is next described. The machine 10 advances with an stroke of about 1.2 meters. This advance is provided by extension of the primary propel cylinders 28. Primary thrust reaction is provided by the gripper shoes 57, 59, and 61 which are expanded to contact the tunnel walls by the gripper cylinders 30 and 36. In crushed ground where the gripper shoes 57, 59, and 61 cannot react the thrust pressure without slipping, auxiliary thrust is provided by the auxiliary thrust cylinders 38 which react against the tunnel lining 22.

The cutterhead 24 then excavates about 1.2 meters of heading. When the advance is completed, the gripper shoes 57, 59, and 61 are retracted by retracting gripper cylinders 30 and 36. The rear shield assembly 14 is then moved forward by retraction of the primary propel cylinders 28 and extension of the rear auxiliary thrust cylinders 38 and the cycle in then repeated. The tail section 20 overlaps the installed tunnel lining 22 for the full advance required to permit installation of the next section of invert segments.

The lubrication oil system provides oil to the cutterhead main bearing 26 and to the six pinions 55 which mesh with the ring gear 39. The lubrication system provides constant oil circulation and filtration. The oil is dispensed through a positive oil distributor which assures the correct lubrication of the various parts. Temperature, pressure, and flow switches are provided to prevent rotation of the cutterhead 24 unless the lubrication oil system is up to operating pressure and flow is established.

The muck handling system consists of the muck buckets 41 (FIG. 1) on the cutterhead 24, the chute 70 on the forward portion of the cutterhead support 32, and the conveyor 43. The cutterhead buckets 41 scoop the muck up from the bottom of the tunnel. Two sets of gravity-type invert scrapers 49 (FIG. 2) are provided to clean the tunnel invert. The muck moves through the muck buckets 41 of the cutterhead 24 and is guided by the deflector 68 (FIG. 1) onto the conveyor loading chute 70 mounted on the forward portion of the cutterhead support 32. The muck is then guided by the chute 70 onto the conveyor 43. The conveyor loading chute 70 is located inside the rotating cutterhead 24. Therefore, any spillage at this point falls back into another cutterhead muck bucket 41 and is returned to the conveyor 43. The machine conveyor 43 transports the muck rearwardly to the trailing equipment (not shown).

The conveyor 43 is an open trough type belt conveyor (as shown in FIG. 4) with a hydraulic drive. The conveyor dump point (not shown) is approximately 21 meters from the face.

The operator's control console 72 (FIG. 4) and operator's chair 74 are located within the rear shield 14. The console 72 includes hydraulic and electric controls and indicating devices which allow for ease of machine operation by a single operator. All hydraulic and electrical controls necessary for machine operation are located at the control console 72. Safety indicators, gauges, and meters provide information of machine functions to the operator.

The indicating devices on the console 72 consist of pressure and temperature gauges, flow indicators, ammeters, and warning lights of the critical functions. The status of the machine is displayed for easy reading by the operator. Automatic safety devices such as bearing oil pressure, flow, temperature, and gripper pressure are interconnected to stop the machine if acceptable operating limits are exceeded.

The hydraulic system consists of industrial class hydraulic equipment. The propel cylinder circuit, the main gripper circuit, and the forward stabilizer circuit are high pressure systems. The shield retract, conveyor drive, and conveyor retract circuits are low pressure systems.

All hydraulic cylinders are designed with a safety factor of two based on the yield of the material at maximum working pressure. All cylinder rods are hardened and chrome plated.

The cutterhead drive motors 34 are 415 volt, two-speed (constant horsepower) alternating current motors. Each motor includes an embedded thermal detector for alarm indication at the control console 72 on overheating. Current transformers are used in each motor circuit with ammeters at the control console 72.

The gear reducer direct drive units in the gearbox assemblies 37 are supplied with air operated clutches. The air clutches allow engagement of all the drive units simultaneously. This feature is helpful in starting the cutterhead 24 under very bad ground conditions where a caving face would tend to block the cutterhead by providing pullout torque of the motors 34 and extra rotary inertial torque from all the motors 34 at once when the clutches are engaged.

The tunnel support installation system consists of a rotary ring beam erector 50 (FIG. 1), a traveling segment hoist (not shown), and rock drills 56. In operation, the traveling segment hoist picks up a concrete invert segment from the trailing platform, travels forward, and sets the segment in the invert, just aft of the auxiliary thrust cylinders 38. The traveling hoist is also used to bring bundles of ring beams 40 forward.

The rotary ring beam erector 50 (FIG. 1) accepts sections of the ring beams 40 and rotates the sections to complete a partial ring. The erector 50 has the capability to travel aft of the tail shield 20 and expand the ring beams 40 against the tunnel wall and the invert segments of the tunnel lining 22. An expansion device on the erector 50 holds the ring until a spacer is manually installed. The placement of corrugated steel sheeting 52 between the tunnel wall and the ring beams 40 occurs in the tail shield 20 and is part of the function of the erector 50.

Traveling rock drill carriages 76 are mounted on rock drill guides 58 and 62 on both sides of the machine conveyor bridge 48. The carriages 76 provide support for the rock drills 56 and allow rock drilling operations to occur during boring operation. Depending on the rock drill selected, rock drill coverage of the top 120° of the tunnel is provided.

A methane monitoring system (not shown) senses the presence of methane gas by diffusion, indicates the percentage concentration by volume, and takes positive action to shut down the machine when methane concentration reaches the high alarm set point.

A laser guidance system (not shown) provides a continuous digital display which indicates machine deviation from true position. The display board is located at the control console 72 (FIG. 4) where the operator immediately sees the machine response to his control adjustments. This laser guidance system, combined with the unique system of continuous steering, allows a skilled operator to maintain an accurate machine position. By means of a selector switch, the operator can also momentarily check machine roll, pitch, grade, and predicted position, all displayed in digital numbers.

Figure 5:
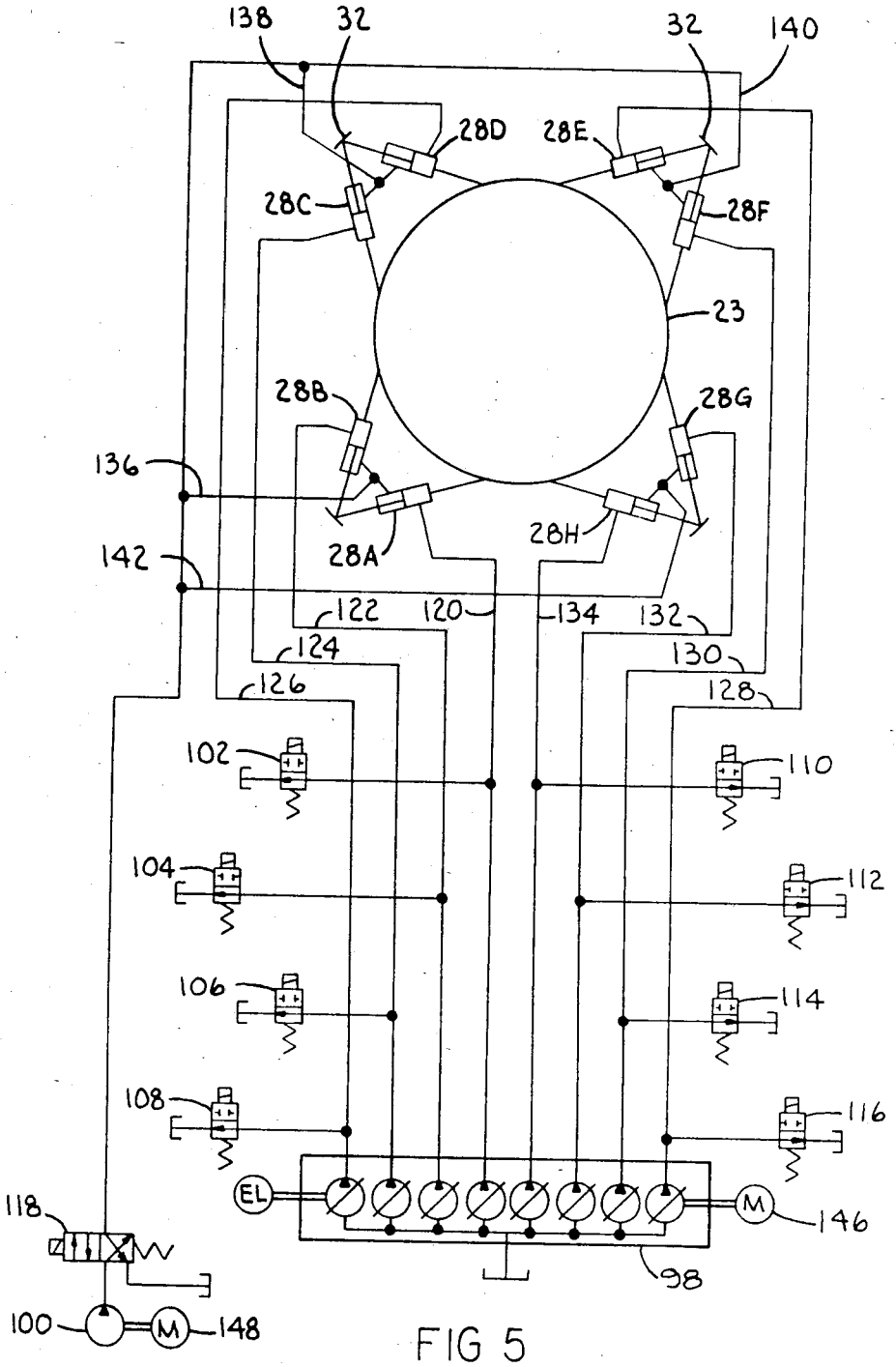
FIG. 5 is a schematic representation of a simplified version of the hydraulic control system for the four pairs of propel cylinders in the first embodiment.

FIG. 5 is a simplified schematic representation of the hydraulic control system for the four pairs of primary propel cylinders 28. The hydraulic circuit consists of an electrically controlled eight-section positive displacement variable volume high pressure pump 98 driven by motor 146, a high volume pump 100 driven by motor 148, nine solenoid-operated directional control valves 102, 104, 106, 108, 110, 112, 114, 116, and 118, and the eight double-acting hydraulic primary propel cylinders 28A, 28B, 28C, 28D, 28E, 28F, 28G, and 28H. The circle 23 schematically represents the gripper support frame and the arcs 32 schematically represent the cutterhead support.

There are four main modes of operation: (1) extend and retract; (2) steer, right and left; (3) steer, up and down; and (4) roll, clockwise and counterclockwise. The four modes of operation are controlled by four conventional three-position electrical switches (not shown) which are mounted on the operator's control console 72.

The extend mode of operation will now be described. When the main electrical control switch is switched to the extend position, the solenoid-operated directional controls valves 102, 104, 106, 108, 110, 112, 114, and 116 are energized, thereby blocking the tank port in each valve. High pressure fluid is thus delivered to the head end of the hydraulic primary propel cylinders 28A, 28B, 28C, 28D, 28E, 28F, 28G, and 28H through lines 120, 122, 124, 126, 128, 130, 132, and 134, respectively. Fluid from the rod end of the cylinders 28A, 28B, 28C, 28D, 28E, 28F, 28G, and 28H returns to the tank through lines 136, 138, 140, 142, and 144, and through solenoid-operated directional control valve 118 which is in the de-energized position.

During the extend mode of operation, the cutterhead 24 is rotating in a clockwise direction as viewed from the rear of the machine 10. Thus, the reaction torque exerted on the cutterhead support 32 is in the counterclockwise direction. The alternate primary propel cylinders 28A, 28C, 28E, and 28G transmit this reaction torque to the gripper support frame 23 which in turn transmits the reaction torque to the gripper system 35. The reaction torque increases the hydraulic fluid pressure in these four alternate cylinders 28A, 28C, 28E, and 28G. However, the four individual sections of the positive displacement variable volume pump 98, which feed these four cylinders 28A, 28C, 28E, and 28G, maintain the higher pressure required to transmit the reaction torque. This prevents the cylinders 28A, 28C, 28E, and 28G from retracting, thereby preventing the cutterhead support 32 from rolling in the counterclockwise direction.

The retract mode of operation will next be described. When the main electrical control switch is switched to the retract position, the solenoid-operated directional control valve 118 is energized thereby allowing the high volume pump 100 to deliver pressurized fluid to the rod end of the cylinders 28A, 28B, 28C, 28D, 28E, 28F, 28G, and 28H through lines 144, 142, 140, 138, and 136. Fluid from the head end of each of the aforementioned hydraulic cylinders returns to the tank through the solenoid-operated directional control valves 102, 104, 106, 108, 110, 112, 114, and 116 which are in the de-energized position.

Steer right is accomplished as follows. With the main electrical control switch in the extend position, the auxiliary electrical switch for steer right/left is switched to the steer right position, thereby short-circuiting the main electrical control switch signal going to solenoid-operated directional control valves 110, 112, 114, and 116. Fluid is thus spilled to tank through the aforementioned valves, and cylinders 28E, 28F, 28G, and 28H assume a dormant state. Solenoid valves 102, 104, 106, and 108 remain energized thus pressurized fluid continues to be delivered as in the extend mode of operation to cylinders 28A, 28B, 28C, and 28D which continue to extend, thereby steering the cutterhead support 32 to the right.

Steer left is accomplished as follows. With the main electrical control switch in the extend position, the auxiliary switch for steer right/left is switched to the steer left position, thereby short-circuiting the main switch signal going to solenoid valves 102, 104, 106, and 108. Fluid is thus spilled to tank through these valves and cylinders 28A, 28B, 28C, and 28D assume a dormant state. Solenoid valves 110, 112, 114, and 116 remain energized thus pressurized fluid continues to be delivered as in the extend mode of operation to cylinders 28E, 28F, 28G, and 28H which continue to extend, thereby steering the cutterhead support 32 to the left.

Steer up is accomplished in the following way. With the main electrical control switch in the extend position, the auxiliary switch for steer up/down is turned to the steer up position, thereby short-circuiting the main switch signal going to solenoid valves 106, 108, 114, and 116. Fluid is thus spilled to tank through these valves, and cylinders 28C, 28D, 28E, and 28F assume a dormant state. Solenoid valves 102, 104, 110, and 112 remain energized thus pressurized fluid is delivered as in the extend mode of operation to cylinders 28A, 28B, 28G, and 28H which continue to extend, thereby steering the cutterhead support 32 up.

Steer down is accomplished as follows. With the main electrical control switch in the extend position, the auxiliary switch for steer up/down is turned to the steer down position thereby short-circuiting the main switch signal going to solenoid valves 102, 104, 110, and 112. Oil is thus spilled to tank through these valves and cylinders 28A, 28B, 28G, and 28H assume a dormant state. Solenoid valves 106, 108, 114, and 116 remain energized thus pressurized fluid is delivered as in the extend mode of operation to cylinders 28C, 28D, 28E, and 28F which continue to extend, thereby steering the cutterhead support 32 down.

The roll clockwise mode of operation is accomplished in the following way. With the main electrical control switch in the extend position, the auxiliary switch for roll corrections is turned to the roll clockwise position thereby short-circuiting the main switch signal to solenoid valves 104, 108, 110, and 114. Oil is thus spilled to tank through these valves and cylinders 28B, 28D, 28F, and 28H assume a dormant state. Solenoid valves 102, 106, 112, and 116 remain energized, thus pressurized fluid is delivered as in the extend mode of operation to the alternate primary propel cylinders 28A, 28C, 28E, and 28G which continue to extend, thereby rolling the cutterhead support 32 in a clockwise direction.

The roll counterclockwise mode of operation is accomplished in the following way. With the main electrical control switch in the extend position, the auxiliary switch for roll corrections is turned to the roll counterclockwise position thereby short-circuiting the main switch signal to solenoid valves 102, 106, 112, and 116. Fluid is thus spilled to tank through these valves and cylinders 28A, 28C, 28E, and 28G assume a dormant state. Solenoid valves 104, 108, 110, and 114 remain energized, thus pressurized fluid is delivered as in the extend mode of operation to the alternate primary propel cylinders 28B, 28D, 28F, and 28H which continue to extend, thereby rolling the cutterhead support 32 in a counterclockwise direction.

Figure 6:
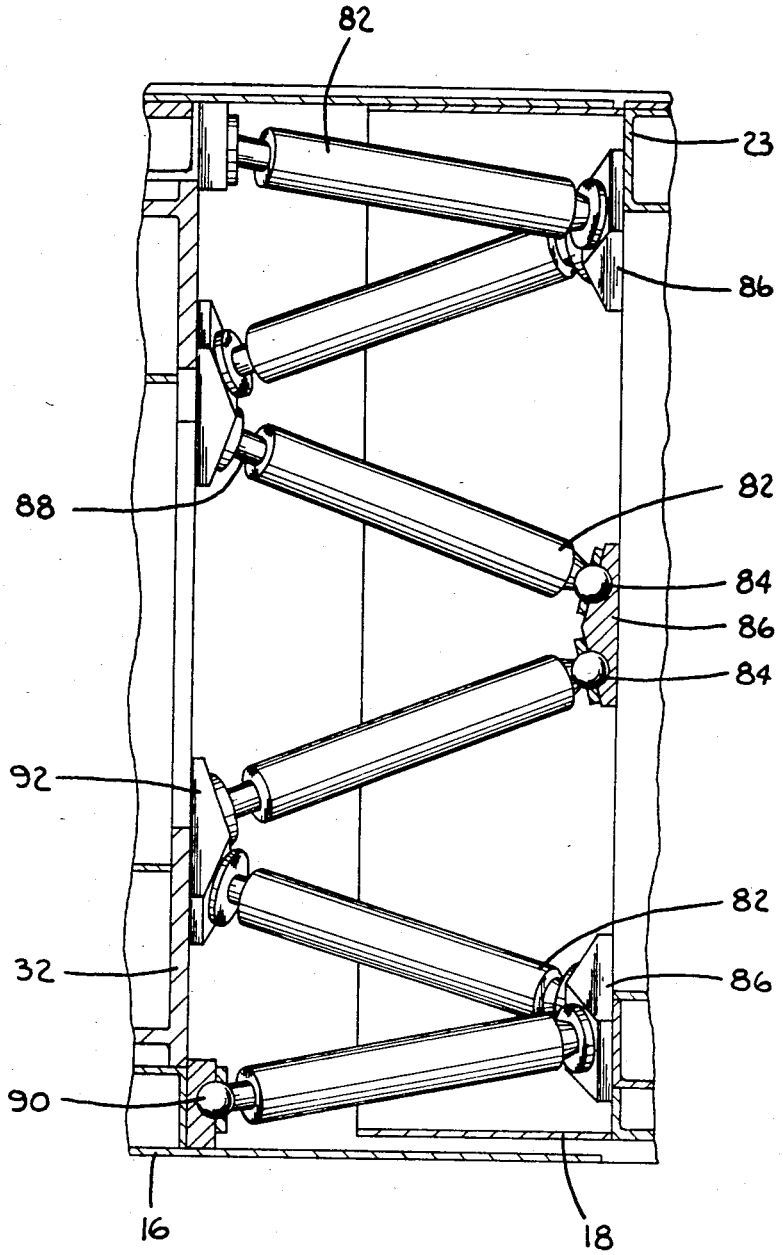
FIG. 6 is a partial longitudinal cross-sectional view of a portion of a second embodiment of a tunnel boring machine constructed according to the principles of the present invention, with some of the machine parts shown in side elevation.

FIG. 6 shows a portion of a second embodiment of a tunnel boring machine constructed according to the principles of the present invention. The second embodiment is different from the first embodiment, described above, in that six pairs of primary propel cylinders 82 in a lattice arrangement are employed. FIG. 6 shows three of the six pairs of primary propel cylinders 82 in the lattice arrangement located between the front shield 12 and the rear shield 14. Each pair of primary propel cylinders 82 is mounted in a V-shaped configuration having an included angle of about 15° to 60° in a plane which is generally parallel to the adjacent portions of the shields and with the line bisecting the included angle between the primary propel cylinders 82 being substantially parallel to the longitudinal centerline 19 of the machine 10. The pairs of primary propel cylinders 82 rigidly tie the first and second shields 12 and 14 together. Furthermore, the primary propel cylinders 82 perform the multiple functions of axial forward thrust when the propel cylinders 82 are all simultaneously actuated, of transmitting reaction torque from the cutterhead support 32 to the gripper system 35 thereby countering the reverse rotary displacement of the cutterhead support 32 caused by the rotary torque applied to the cutterhead 24 by the motors 34, of steering by selectively actuating specific propel cylinders 82 causing angular displacement of the front shield 12, the cutterhead support 32, and the cutterhead 24 relative to the rear shield 14 which is held stationary in the tunnel by the gripper system 35, and of roll corrections by selectively actuating alternate propel cylinders 82 causing clockwise or counterclockwise rotation of the front shield 12, the cutterhead support 32, and the cutterhead 24 relative to the rear shield 14 which is held stationary in the tunnel by the gripper system 35. Thus, the pairs of primary propel cylinders 82 have a thrust function, a reaction torque function, a steering function, and a roll correction function as in the first embodiment described above. The term "lattice" is specially defined for the purpose of this invention as a series of interconnected pairs of hydraulic cylinders in V-shaped arrangement per pair and in an annular array of pairs.

As shown in FIG. 6, the head end of each primary propel cylinder 82 has a terminal portion 84 shaped in the form of a sphere which fits into a correspondingly-shaped spherical socket in a rear mounting bracket 86. Each rear mounting bracket 86 has two spherical sockets in order to receive the terminal portions 84 of two primary propel cylinders 82. Furthermore, each primary propel cylinder 82 has a rod 88 which terminates in a spherical ball 90 which is received in a correspondingly-shaped spherical socket in a forward mounting bracket 92. Each forward mounting bracket 92 has two spherical sockets in order to receive the rods 88 of two propel cylinders 82.

Figure 7:
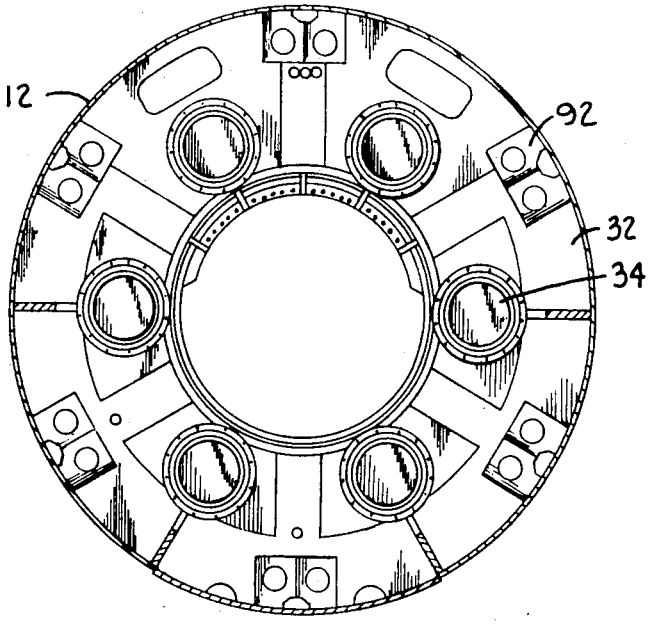
FIG. 7 is a radial cross-sectional rear view (analogous to FIG. 3) of the front shield portion of a second embodiment of the invention.

FIG. 7 is a cross-sectional view looking foward at the front shield 12 in the second embodiment of a tunnel boring machine constructed according to the present invention. As in the first embodiment described above, the second embodiment has six electric motors 34 for driving the cutterhead 24. The six forward mounting brackets 92 for receiving the propel cylinders 82 are equally spaced around the circular shape of the cutterhead support 32 within the front shield 12.

Figure 8:
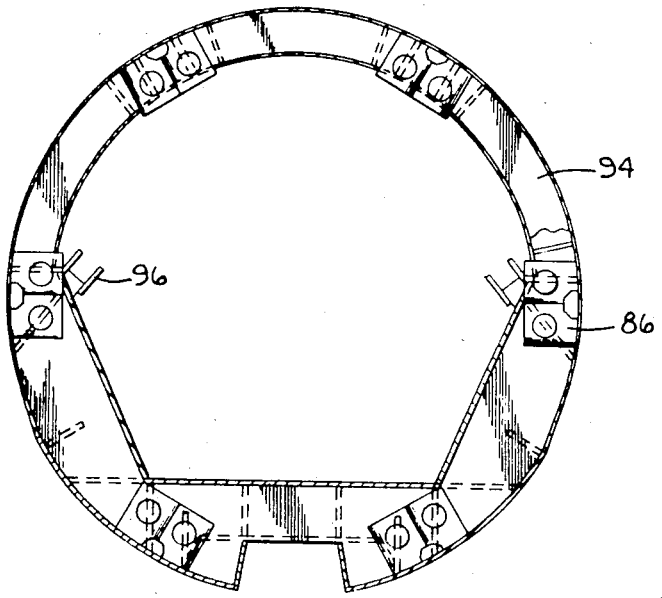
FIG. 8 is a radial cross-sectional front view of the rear shield/gripper support frame portion of a second embodiment of the invention.

FIG. 8 shows a cross-sectional view looking rearward at the rear shield/gripper support frame 94 in the second embodiment of a tunnel boring machine constructed according to the present invention. The six rear mounting brackets 86 are shown mounted on the rear shield/gripper support frame 94. The six rear mounting brackets 86 are equally spaced around the circular shape of the frame 94. The mounting brackets 96 for the gripper cylinders which actuate the upper gripper shoe 57 are also mounted on the gripper support frame 94.

The hydraulic control system for the six pairs of primary propel cylinders 82 employed in the second embodiment of the invention is similar in principle to the hydraulic control system shown in FIG. 5 for the four pairs of primary propel cylinders 28 in the first embodiment of the invention.

As will be apparent to those skilled in the art to which the invention is addressed, the present invention may be embodied in forms other than those specifically disclosed above without departing from the spirit or essential characteristics of the invention. The particular embodiments of the tunnel boring machine, as described above, are therefore to be considered in all respects illustrative and not restrictive, with the scope of the present invention being set forth in the appended claims rather than being limited to the foregoing description.

What is claimed is:

1. A tunnel boring machine comprising:

(a) a full face rotary cutterhead means;

(b) a cutterhead support means on which said cutterhead is mounted;

(c) gripper means carried by a gripper support frame means for reacting machine thrust, steering, and torque forces;

(d) a conveyor system for transporting muck from behind the cutterhead means to a dump point rearwardly of the machine;

(e) a primary propel system for advancing said cutterhead, said primary propel system being mounted between said gripper support frame means and said cutterhead support means, said primary propel system comprising a series of at least three pairs of double acting hydraulic propel cylinders arranged annularly in equally spaced apart locations and in a series of V-shaped configurations between said gripper support frame means and said cutterhead support means, each such pair of cylinders having an included angle between the cylinders of about 15° to 60° and with a line bisecting the included angle between the cylinders extending generally parallel to the longitudinal centerline of the machine;

(f) a hydraulic system delivering pressurized hydraulic fluid to said pairs of double acting hydraulic propel cylinders and including multi-section positive displacement pump means with each pump section delivering high pressure fluid to an associated propel cylinder; and (g) hydraulic system control means for controlling said pairs of hydraulic primary propel cylinders to effect (1) axial forward thrust on the cutterhead means by simultaneous delivery of an equal volume of hydraulic fluid to all the propel cylinders from the respective associated sections of said positive displacement pump means, the equal additional volume of fluid introduced to each cylinder thereby transmitting the reaction torque exerted on the cutterhead support means by rotation of the cutterhead means to said gripper support frame means by reason of the higher pressure generated in alternate propel cylinders and without roll of the cutterhead support means, (2) steering of the cutterhead support means and said cutterhead means by selective delivery of unequal volumes of hydraulic fluid to the propel cylinders at one side of the propel system, and (3) roll corrections of said cutterhead support means and said cutterhead means by selective delivery of unequal volumes of hydraulic fluid to alternate propel cylinders.

2. The tunnel boring machine of claim 1, wherein said primary propel system comprises four pairs of double acting hydraulic cylinders.

3. The tunnel boring machine of claim 1, wherein said primary propel system comprises six pairs of double acting hydraulic cylinders arranged in a lattice of interconnected V-shaped pairs with each of said cylinders sharing a mounting means with an adjacent cylinder.

4. In a tunnel boring machine comprising:

a full face rotary cutterhead means, a cutterhead support means, a forward shield surrounding the cutterhead support means and providing ground support immediately behind the cutterhead means, a rear shield in articulated, telescoped arrangement within and behind the forward shield, a large area gripper means carried by the rear shield and providing low unit ground loading for reacting machine thrust, steering, and torque forces, and including a tail section providing cover for the erection of tunnel lining, a conveyor system for transporting muck from behind the cutterhead to a dump point rearwardly of the machine, a primary propel system acting between said forward and rear shields for advancing the forward shield with respect to the rear shield, and auxiliary thrust means for advancing said rear shield with respect to the tunnel lining;

the improvement wherein said primary propel system comprises a series of at least three pairs of double-acting hydraulic propel cylinders arranged annularly in equally spaced apart locations and in V-shaped configuration between the forward and rear shields, each such pair of cylinders having an included angle between the cylinders of about 15° to 60° and with a line bisecting the included angle between the cylinders extending generally parallel to the longitudinal centerline of the machine;

said improvement further comprising a hydraulic system delivering pressurized hydraulic fluid to said pairs of double acting hydraulic propel cylinders and including multi-section positive displacement pump means with each pump section delivering high pressure fluid to an associated propel cylinder; and hydraulic system control means for controlling said pairs of hydraulic primary propel cylinders to effect (1) axial forward thrust on the cutterhead means by simultaneous delivery of an equal volume of hydraulic fluid to all the propel cylinders from the respective associated sections of said positive displacement pump means, the equal additional volume of fluid introduced to each cylinder thereby transmitting the reaction torque exerted on the cutterhead support means by rotation of the cutterhead means to said gripper support frame means by reason of the higher pressure generated in alternate propel cylinders and without roll of the cutterhead support means, (2) steering of the cutterhead support means and said cutterhead means by selective delivery of unequal volumes of hydraulic fluid to the propel cylinders at one side of the propel system, and (3) roll corrections of said cutterhead support means and said cutterhead means by selective delivery of unequal volumes of hydraulic fluid to alternate propel cylinders.

5. The tunnel boring machine of claim 4, wherein said primary propel system comprises four pairs of double-acting hydraulic cylinders.

6. The tunnel boring machine of claim 4, wherein said primary propel system comprises six pairs of double-acting hydraulic cylinders arranged in a lattice of interconnected V-shaped pairs with each of said cylinders sharing a mounting means with an adjacent cylinder.

* * * * *